US006019191A

United States Patent [19]

Flores

[11] Patent Number: 6,019,191

[45] Date of Patent: Feb. 1, 2000

[54] LADDER SUPPORT SYSTEM

[76] Inventor: Leonard A. Flores, 49021 N. 13th Ave., Phoenix, Ariz. 85027

[21] Appl. No.: 09/259,421

[22] Filed: Feb. 26, 1999

[51] Int. Cl.[7] ..... E06C 7/48

[52] U.S. Cl. ..... 182/107; 182/214

[58] Field of Search ..... 182/107, 214

[56] References Cited

U.S. PATENT DOCUMENTS

| | | | |
|---|---|---|---|
| 1,467,597 | 9/1923 | Wendel | 182/214 |
| 4,440,263 | 4/1984 | Smith | 182/107 |
| 4,787,478 | 11/1988 | Stakes | 182/214 |
| 4,880,079 | 11/1989 | Leclerc | 182/107 |
| 5,358,071 | 10/1994 | Stennett | 182/107 |
| 5,664,643 | 9/1997 | Taylor | 182/214 |
| 5,775,465 | 7/1998 | Vossler | 182/214 |

FOREIGN PATENT DOCUMENTS

| | | | |
|---|---|---|---|
| 556100 | 10/1930 | Germany | 182/214 |
| 807992 | 4/1951 | Germany | 182/109 |
| 2145146 | 3/1985 | United Kingdom | 182/107 |

*Primary Examiner*—Alvin Chin-Shue

*Attorney, Agent, or Firm*—Warren F. B. Lindsley; Frank J. McGue

[57] ABSTRACT

A ladder support system for use in securely mooring the top of a ladder to a roof while simultaneously eliminating any destructive contact between the ladder and the roof materials. The ladder support system includes a pair of frame portions which are secured to the roof and which are structured to support opposite ends of a bar. To prevent the ladder from rotating away from the roof when being used, a strap is provided for securing the ladder to the bar. Each frame portion is provided with a blocking means to prevent lateral movement of the ladder when the ladder is supported by the bar. A means is also provided to prevent accidental loss of bar support at each frame portion.

7 Claims, 2 Drawing Sheets

LADDER SUPPORT SYSTEM

BACKGROUND OF THE INVENTION

1. Field of the Invention

This invention relates to a ladder support system. More particularly, this invention concerns a ladder support system for use in securely mooring the top of a ladder to a roof while simultaneously eliminating any destructive contact between the ladder and the roof materials.

2. Description of the Prior Art

Typically, a ladder is often used to obtain access to roof-mounted air conditioning and/or evaporation units, aerial antennas, to perform roof repairs, or for any other reason for which access to the roof may be required. The typical method of using a ladder to obtain access to the roof consists of simply propping the ladder against the leading edge of the roof in such a manner that the side rails of the ladder are in direct contact with the material comprising the roof top layer. In those cases in which the top layer comprises shingles, direct contact between the shingles and the ladder often-times results in damage to the individual shingles leading to potentially undesirable consequences. Such consequences include, for example, an unsightly roof appearance and possible roof structure damage caused by potential moisture permeation through the damaged shingles leading to rot in the underlying roof structure.

In addition, safety is also a factor to consider in using a ladder to obtain access to a roof. Unless the ladder is properly supported when being ascended or descended (either by incorporating the help of a separate person to hold the ladder or by using other means), using a ladder to obtain access to a roof is a source of preventable injury caused, for example, by the ladder tipping away from the roof or laterally sliding from its supported position. Thus, it is believed by the applicant that there exists a need for a ladder support system which will address the concerns expressed herein.

OBJECTS OF THE INVENTION

A primary object of the present invention is to fulfill the above-mentioned need by the provision of a ladder support system. A further primary object of the present invention is to provide such a system which is efficient, easy to use, easy to manufacture, inexpensive, and handy. Other objects of this invention will become apparent with reference to the following invention descriptions.

SUMMARY OF THE INVENTION

According to a preferred embodiment of the present invention, this invention provides a ladder support system for use in providing a secure mooring of a ladder adjacent a roof so as to avoid destructive contact of the ladder with the roofing cover materials, comprising, in combination: support means for rigidly supporting such ladder adjacent such roof; and first attachment means for attaching such support means to such roof. And, it provides such a ladder support system further comprising a second attachment means for securely attaching such ladder to such support means; and, further, wherein such second attachment means comprises a releasable strap. This invention also provides for such a ladder support system wherein such first attachment means comprises a set of threaded fasteners.

In addition, this invention provides such a ladder support system wherein such support means comprises: a bar having a length sufficient to support a width of such ladder; and a set of frame portions structured and arranged to support such bar. Also, it provides for such a ladder support system wherein: such bar comprises a first end and a second end, and such set of frame portions comprises: a first frame portion structured and arranged to support such first end of such bar and a second frame portion structured and arranged to support such second end of such bar, such second frame portion being separated from such first frame portion by a distance sufficient to accommodate such width of such ladder within such distance. And, this invention provides such a ladder support system wherein such support means further comprises first blocking means for essentially preventing lateral movement of such ladder when such ladder is supported by such support means; and, further still, wherein such first blocking means comprises a semi-circular blocking structure attached to each of such frame portions adjacent such support, such blocking structure defining a plane being substantially normal to a longitudinal axis of such bar.

Further, this invention provides such a ladder support system wherein such support means further comprises second blocking means for preventing accidental loss of such support of such bar adjacent such first frame portion and such second frame portion; and, yet further still, wherein such second blocking means comprises at least two mechanical fasteners, each such mechanical fastener being structured and arranged to be attached adjacent a such end of such bar in such manner as to be in a blocking engagement with a such frame portion when such ladder support system is in place for use. Also, it provides such a ladder support system wherein such support means further comprises an adjustment means for adjusting such distance between such first frame portion and such second frame portion; and, wherein such adjustment means comprises a hole in such first frame portion and a hole in such second frame portion, such holes being structured and arranged for slideable engagement with such bar. Further still, this invention provides for such a ladder support system further comprising a releasable strap, such releasable strap being structured and arranged to securely attach such ladder to such support means; and, wherein such first attachment means comprises a set of threaded fasteners. Even further, this invention provides for such a ladder support system wherein such support means further comprises: second blocking means for preventing accidental loss of such support of such bar adjacent such first frame portion and such second frame portion; adjustment means for adjusting such distance between such first frame portion and such second frame portion; and second attachment means for securely attaching such ladder to such support means.

Even further still, this invention provides for such a ladder support system wherein: such bar comprises a substantially round bar; such first blocking means comprises a semi-circular blocking structure attached to each of such frame portions adjacent such support, such blocking structure defining a plane being substantially normal to a longitudinal axis of such bar; such second blocking means comprises at least two mechanical fasteners, each such mechanical fastener being structured and arranged to be attached adjacent a such end of such bar in such manner as to be in a blocking engagement with a such frame portion when such ladder support system in place for use; such adjustment means comprises a hole in such first frame portion and a hole in such second frame portion, such holes being structured and arranged for slideable engagement with such bar; such first attachment means comprises a set of threaded fasteners; each of such frame portions comprises: a substantially planar bottom portion being structured and arranged to lie adjacent such roof cover materials, such planar bottom portion having a plurality of holes structured and arranged for receipt of such threaded fasteners, a substantially planar side portion attached to side planar bottom portion and extending substantially perpendicularly therefrom; and such second attachment means comprises a releasable strap structured and arranged for securing such ladder to such bar. Additionally, it provides for such a ladder support system wherein: each of such planar bottom portions comprises a substantially rectangular structure having a length of about 10¾ inches, a width of about 1¾ inches, and a thickness of about ⅛ inch; such bar has a length of about 20 inches and an outer diameter of about 15/16 inch; each of such planar side portions has a length of about one foot and a thickness of about ⅛ inch; such releasable strap comprises an essentially nylon strap having a length of about 30 inches; such bar comprises an essentially aluminum material; each of such planar bottom portions comprise an essentially aluminum material; and each of such planar side portions comprise an essentially aluminum material.

In addition, according to a preferred embodiment thereof, this invention provides for a method of providing a secure mooring of a ladder, having a pair of side rails, adjacent a roof so as to avoid destructive contact of the ladder with the roofing cover materials, comprising the steps of: providing a ladder support system comprising a bar having a first end and a second end and having a length sufficient to support a width of such ladder, a first frame portion having a first planar bottom portion and a first planar side portion, such first frame portion being structured and arranged to support such first end of such bar, and a second frame portion having a second planar bottom portion and a second planar side portion, such second frame portion being structured and arranged to support such second end of such bar; attaching such first planar bottom portion of such first frame portion to such roof; attaching such second planar bottom portion of such second frame portion to such roof so that such second side portion is separated from such first side portion by a distance sufficient to accommodate such width of such ladder therebetween; placing such rails of such ladder on such bar; and securing such ladder to such bar. And, still further, it provides such a method wherein such first planar side portion and such second planar side portion are structured and arranged with respective such planar bottom portions inwardly located upon attachment to such roof. Additionally, it provides for such a method wherein such first planar side portion and such second planar side portion are structured and arranged with respective such planar bottom portions outwardly located upon attachment to such roof.

DETAILED DESCRIPTION OF A PREFERRED EMBODIMENT AND THE BEST MODE OF PRACTICE

Figure 1:
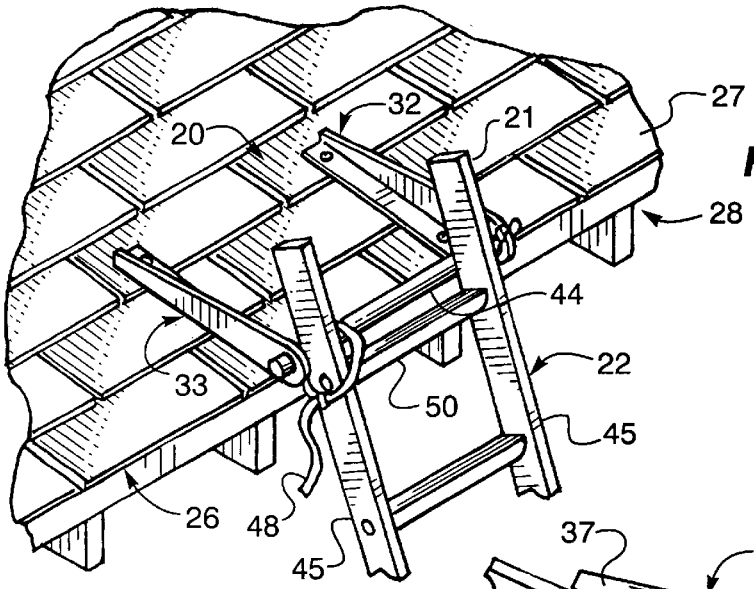
FIG. 1 is a perspective view of a preferred embodiment of the ladder support system in its use environment.
Figure 2:
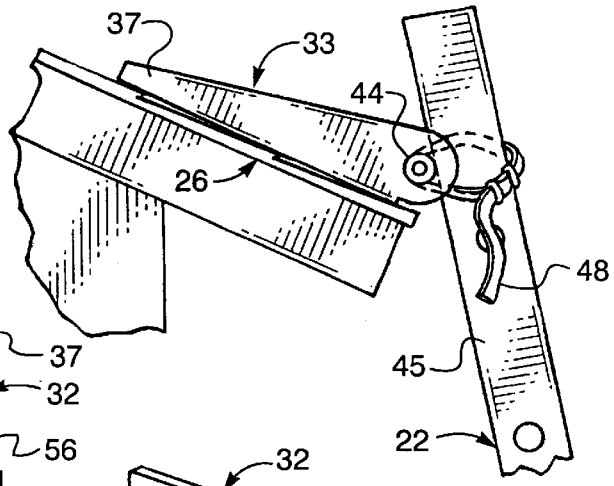
FIG. 2 is a side view of the arrangement of FIG. 1.

With reference now to the Figures, shown in perspective and elevation, respectively, in FIGS. 1 and 2 is a preferred embodiment of the ladder support system 20 of the present invention in use in its working environment. As will be appreciated by those skilled in such art as this disclosure progresses, the present invention is structured and arranged to simultaneously satisfy at least two beneficial functions: (1) provide a safe and secure mooring for the top portion 21 of a ladder 22; and (2) to protect the roofing cover material 26, namely those roofing cover materials comprising shingles 27, on roof 28 from possible damage caused by contact with the ladder 22.

Figure 3:
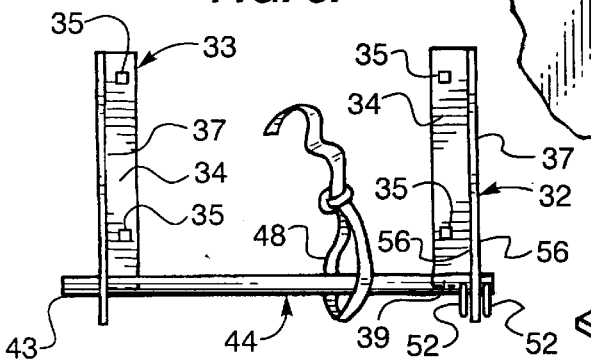
FIG. 3 is a plan view of the present invention.
Figure 4:
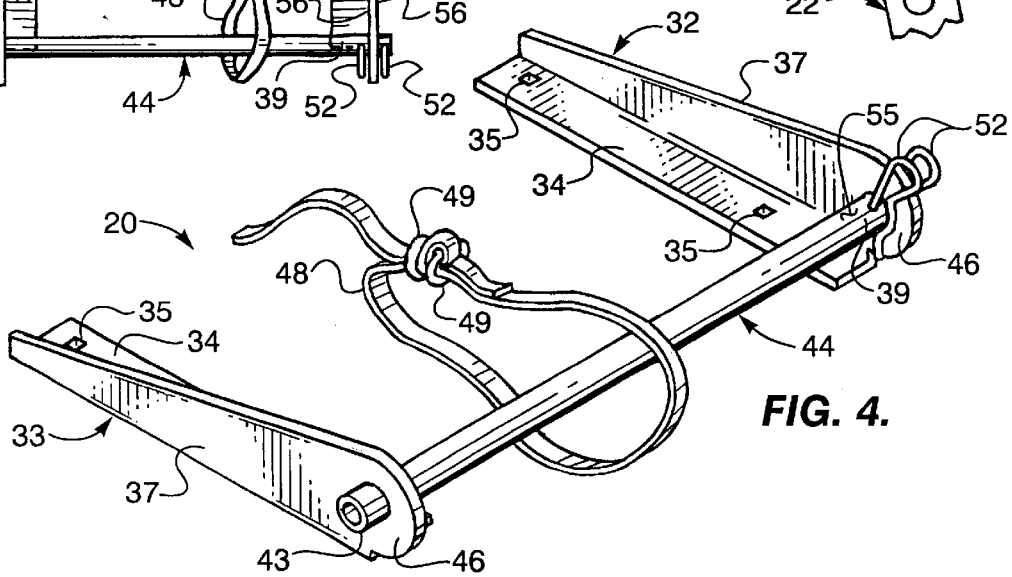
FIG. 4 is a perspective view of the present invention.
Figure 5:
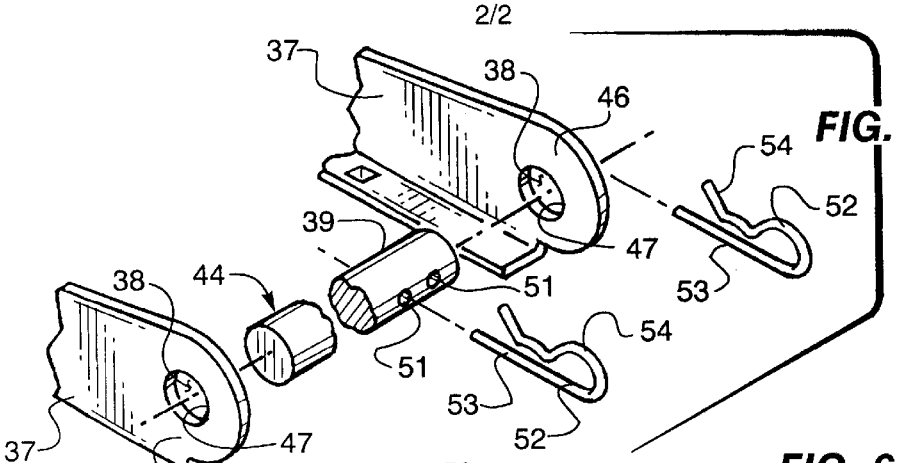
FIG. 5 is an partial exploded view of the present invention illustrating a preferred arrangement for securing the bar to the frame portion.

Referring further to FIGS. 1 and 2, and introducing FIGS. 3 through 5, the structural details of the ladder support system 20 will now be disclosed. The ladder support system 20 comprises a first frame portion 32 separated by a distance from an opposing second frame portion 33. Each respective frame portion 32 and 33 comprises a substantially rectangular planar bottom portion 34, preferably comprising an aluminum material and having preferred dimensions of approximately 10¾ inch by 1¾ inch by ⅛ inch thick, which is structured and arranged to lie atop shingles 27. Each planar bottom portion 34 is provided with a plurality of holes 35 which are used to facilitate attachment of each respective frame portion 32 and 33 to roof 28. Attached to each planar bottom portion 34, and extending upwardly substantially perpendicularly therefrom, is a planar side portion 37, preferably shaped as shown, which preferably comprises an aluminum material having a preferred thickness of approximately ⅛ inch and a preferred length of about one foot. As shown best in FIG. 5, each planar side portion 37 is provided with a substantially circular hole 38 which is structured and arranged to support a respective end portion 39 and 43 of a removable bar 44. The bar 44 preferably comprises a hollow aluminum round cylinder, as shown, having a preferred length of approximately 20 inches and a preferred outside diameter of approximately 15/16 inch. The bar 44 and frame portions 32 and 33 embody herein support means for rigidly supporting such ladder adjacent such roof.

As will be appreciated by those skilled in such art, the ladder support system 20 includes a number of safety features to ensure that ladder 22 remains securely moored when in use. To provide lateral support to the ladder 22 when the ladder side rails 45 are supported by the bar 44, it is preferred that the leading edge 46 of each planar side portion 37 extend past the outer diameter of bar 44 for a distance of at least one inch. As further shown in FIG. 5, each leading edge 46 preferably comprises a semi-circular blocking structure extending radially from the perimeter 47 of each hole 35 for the aforementioned preferred one inch distance. When each planar side portion 37 is structured and arranged in such a manner, the ladder 22 is prevented from any substantial movement parallel to the longitudinal axis of bar 44, with any such movement resulting in a blocking contact between a leading edge 46 and a side rail 45 of ladder 22. Each leading edge 46 embodies herein first blocking means for essentially preventing lateral movement of such ladder when such ladder is supported by such support means; and, wherein such first blocking means comprises a semi-circular blocking structure attached to each of such frame portions adjacent such support, such blocking structure defining a plane being substantially normal to a longitudinal axis of such bar. To prevent the ladder 22 from overturning when being ascended or descended, the present invention also provides for a releasable strap 48. The releasable strap 48 illustrated and described herein comprises a well-known and commercially available strap preferably made of a synthetic fiber such as nylon. In addition, the releasable strap 48 of the type described herein is provided with a pair of loops 49 (as shown best in FIG. 4) which are structured and arranged for gripping, in well-known ways, a portion of the releasable strap 48 material, thereby forming an adjustable loop for releasably cinching a side rail 45 of ladder 22 to bar 44, as shown in FIGS. 1 and 2. The releasable strap 48 embodies herein a second attachment means for securely attaching such ladder to such support means. Alternatively, the releasable strap 48 may be arranged to encircle the bar 44 and a rung 50 adjacent bar 44 (such arrangement not shown).

Figure 6:
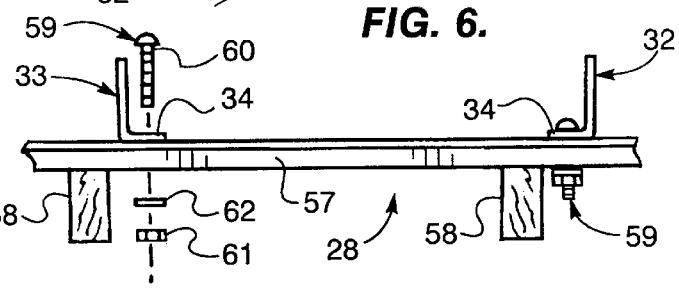
FIG. 6 is an elevation view of the present invention illustrating a preferred method of attaching the ladder support system of the present invention to a roof.
Figure 7:
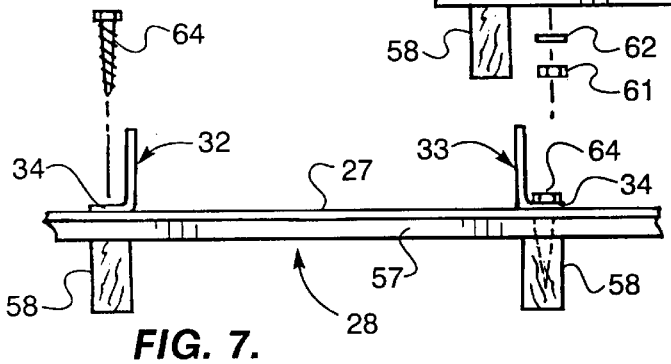
FIG. 7 is an elevation view of the present invention illustrating a another preferred method of attaching the ladder support system of the present invention to a roof.

Though the specific details of attaching the ladder support system 20 to a roof 28 will be disclosed more fully with respect to FIGS. 6 and 7, reference should now be made to the fact that the respective frame portions 32 and 33 should be spaced a sufficient distance apart (herein referred to as separation distance) so as to accommodate the width of the ladder 22 between each planar side portion 37, as shown in FIG. 1. In addition, it is preferred that each hole 38 have a diameter slightly greater in size than the outer diameter of bar 44 so as to allow for adjustment of the aforementioned separation distance (e.g., by sliding a respective frame portion 32 or 33 along bar 44) which may be necessary in order to accommodate roof obstructions or varying roof contours encountered during installation. The holes 38 embody herein an adjustment means for adjusting such distance between such first frame portion and such second frame portion; and, wherein such holes being structured and arranged for slideable engagement with such bar. To prevent any potential loss of the aforementioned support of the bar 44 at either frame portion 32 or 33 when the ladder support system 20 is in use, the present invention provides for a means to secure the bar 44 in place. As shown best in FIG. 5, either end portion 39 or 43 of bar 44 may be provided with a pair of adjacent holes 51 which are separated by a distance sufficient to accommodate the width of a planar side portion 37 therebetween. Securing the bar 44 in place consists of simply sliding bar 44 through hole 38 until the planar side portion 37 lies between holes 51, as shown best in FIGS. 3 and 4. Next, fasteners 52, preferably comprising galvanized hitch-pins of the type well-known in such art and having a sufficient longitudinal length so as to prevent their passage through hole 38, are attached to the bar 44. The hitch-pins of the type described herein typically comprise a substantially straight first leg 53 which, for purposes of the present invention, is structured and arranged to engage a hole 51, and an angled second leg 54 which is structured and arranged to snugly grip, in well-known ways, the outer surface 55 of bar 44 (as shown best in FIG. 4). When so arranged, the end portions 39 and 43 of bar 44 are effectively prevented from becoming dislodged from their respective holes 35 due to blocking contact between the fasteners 52 and each adjacent surface 56 of a planar side portion 37 (as shown best in FIG. 3). The fasteners 52 embody herein second blocking means for preventing accidental loss of such support of such bar adjacent such first frame portion and such second frame portion.

Shown in elevation in FIGS. 6 and 7 are two methods of attaching the ladder support system 20 of the present invention to a roof 28. For each attachment method shown in FIGS. 6 and 7, the roof 28 is of a standard construction and consists of a layer of shingles 27 attached to a base board 57 which, in turn, is attached to a plurality of roof trusses 58. Shown in FIG. 6 is the preferred method of attaching the ladder support system 20 to roof 28. As shown, each respective frame portion 32 and 33 is positioned on the roof 28 such that each planar bottom portion 34 is inwardly located, as shown. To ensure that the ladder 22 does not contact shingles 27, it is preferred that each respective frame portion 32 and 33 be placed on the roof 28 so that the ladder 22 is always maintained at a distance of at least ½ inch from the shingles 27, such as the arrangement shown in FIG. 2.

Upon achieving proper positioning, pilot holes (not shown) are drilled through shingles 27 and base board 57 at the location of each hole 35 so as to accommodate, preferably, a carriage bolt 59 (embodying herein first attachment means for attaching such support means to such roof). As shown in FIGS. 3–5, it is preferred that each hole 35 have a substantially square circumference which is sized to properly engage, in well-known ways, the square neck 60 of carriage bolt 59. With each carriage bolt 59 in place, each respective frame portion 32 and 33 is secured to the roof 28 by attaching, in well-known ways, a nut 61 and flat washer 62 to each carriage bolt 59. Alternatively, each respective frame portion 32 and 33 may be secured to the trusses 58 by use of a set of threaded screw-type fasteners 64 (embodying herein first attachment means for attaching such support means to such roof), as shown in FIG. 7. To conveniently accommodate various installation conditions encountered on the roof 28, the respective frame portions 32 and 33 are interchangeable and may be attached to the roof 28 with each planar bottom portion 34 inwardly located (as shown in FIG. 6) or outwardly located (as shown in FIG. 7). The disclosed attachment methods embody herein the steps of: providing a ladder support system comprising a bar having a first end and a second end and having a length sufficient to support a width of such ladder, a first frame portion having a first planar bottom portion and a first planar side portion, such first frame portion being structured and arranged to support such first end of such bar, and a second frame portion having a second planar bottom portion and a second planar side portion, such second frame portion being structured and arranged to support such second end of such bar; attaching such first planar bottom portion of such first frame portion to such roof; and attaching such second planar bottom portion of such second frame portion to such roof so that such second side portion is separated from such first side portion by a distance sufficient to accommodate such width of such ladder therebetween.

Figure 8:
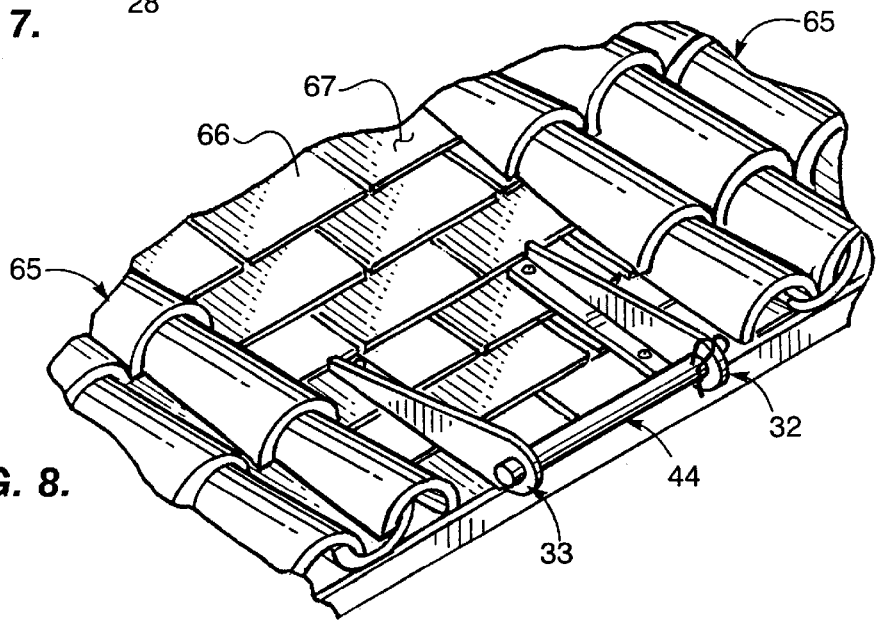
FIG. 8 is a perspective view of the present invention illustrating the preferred attachment location of a the ladder support system for tile roofs.

As shown in FIG. 8, the ladder support system 20 of the present invention may be easily incorporated onto those tile roofs 65 which are provided with a walkway 66 for allowing access to air conditioning and/or evaporation units, aerial antennas, or other roof mounted devices. In view of the fact that the walkways 66 referred to herein typically comprise a shingle surface 67, attachment of the ladder support system 20 to the walkway 66 may be in accordance with the methods described hereinabove with respect to FIGS. 6 and 7.

Although applicant has described applicant's preferred embodiments of this invention, it will be understood that the broadest scope of this invention includes such modifications as diverse shapes, sizes and materials. Such scope is limited only by the below claims as read in connection with the above specification. Further, many other advantages of applicant's invention will be apparent to those skilled in the art from the above descriptions and the below claims.

What is claimed is:

1. A support system for providing a secure mooring of a ladder adjacent a roof so as to avoid destructive contact of the ladder with the roofing cover materials, comprising, in combination:

support means for rigidly supporting a ladder adjacent a roof of a building;

first attachment means comprising a set of threaded fasteners for attaching said support means to said roof;

a second attachment means comprising a releasable strap connected to said bar for securely attaching said ladder to said bar;

said support means comprising a bar having a length sufficient to support a width of said ladder;

a set of frame portions structured and arranged to support said bar;

said bar comprises a first end and a second end;

said set of frame portions comprises a first frame portion slidably receiving said first end of said bar and a second frame portion said second end of said bar;

said second frame portion being separated from said first frame portion by a distance sufficient to accommodate said width of said ladder within said distance; and a blocking means for substantially preventing lateral movement of said ladder when said ladder is supported by said support means;

said blocking means comprises a semi-circular blocking structure integral with each of said frame portions, said blocking structure defining a plane being substantially normal to a longitudinal axis of said bar, each of said frame portions comprises a substantially planar bottom portion being structured and arranged to lie adjacent said roof cover materials; said planar bottom portion having a plurality of holes structured and arranged for receipt of said threaded fasteners, and a substantially planar side portion attached to a side edge of said planar bottom portion and extending substantially perpendicularly therefrom, said blocking means being integral with said side portion and extending beyond an end edge of said planar bottom portion.

2. The ladder support system set forth in claim 1 wherein:

said comprising blocking means comprising at least two mechanical fasteners;

each of said mechanical fastener being structured and arranged to be attached adjacent said first end of said bar in such manner as to be in a blocking engagement with said first frame portion when said ladder support system is in place for use.

3. The ladder support system as set forth in claim 1 wherein:

said support means further comprises an adjustment means for adjusting the distance between said first frame portion and said second frame portion.

4. The ladder support system as set forth in claim 3 wherein:

said adjustment means comprises a hole in said first frame portion and a hole in said second frame portion; and said holes being structured and arranged for slidable engagement with said bar.

5. The ladder support system as set forth in claim 3 wherein said support means comprises:

second blocking means for preventing accidental.

6. The ladder support system as set forth in claim 5 wherein:

said bar comprises a substantially round configuration;

said second blocking means comprises at least two mechanical fasteners;

each of said mechanical fastener being structured and arranged to be attached adjacent a first end of said bar in such manner as to be in blocking engagement with said frame portion when said ladder support system is in place for use;

said adjustment means comprises a hole in said first frame portion and a hole in said second frame portion;

said holes being structured and arranged for slidable engagement with said bar.

7. The ladder support system as set forth in claim 6 wherein:

each of said planar bottom portions comprises a substantially rectangular structure having a length of about 10¾ inches, a width of about 1¾ inches, and a thickness of about ⅛ inch;

said bar has a length of about 20 inches and an outer diameter of about 15/16 inch;

each of said planar side portions has a length of about one foot and a thickness of about ⅛ inch;

said releasable strap comprises an essentially nylon strap having a length of about 30 inches;

said bar comprises an essentially aluminum material;

each of said planar bottom portions comprise an essentially aluminum material; and each of said planar side portions comprise an essentially aluminum material.

* * * * *